US009598945B2

(12) United States Patent
Okoniewski et al.

(10) Patent No.: US 9,598,945 B2
(45) Date of Patent: Mar. 21, 2017

(54) SYSTEM FOR EXTRACTION OF HYDROCARBONS UNDERGROUND

(71) Applicant: Chevron U.S.A. Inc., San Ramon, CA (US)

(72) Inventors: Michal Okoniewski, Calgary (CA); Damir Pasalic, Calgary (CA); Pedro Vaca, Calgary (CA); Gunther Hans Dieckmann, Walnut Creek, CA (US); Donald Leroy Kuehne, Hercules, CA (US); Miguel Vigil, Richmond, CA (US); Stein J. Storslett, Bakersfield, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/746,367

(22) Filed: Jun. 22, 2015

(65) Prior Publication Data

US 2015/0322759 A1 Nov. 12, 2015

Related U.S. Application Data

(63) Continuation-in-part of application No. 13/838,783, filed on Mar. 15, 2013, and a continuation-in-part of (Continued)

(51) Int. Cl.
*H01Q 9/28* (2006.01)
*E21B 43/24* (2006.01)

(Continued)

(52) U.S. Cl.
CPC ..... *E21B 43/2401* (2013.01); *H01Q 1/04* (2013.01); *H01Q 9/22* (2013.01); *H01Q 9/28* (2013.01);

(Continued)

(58) Field of Classification Search
CPC ..... H01Q 9/285; H01Q 9/30; H01Q 1/1271; H01Q 9/26; H01Q 21/24; H01Q 19/10; H01Q 1/38

(Continued)

(56) References Cited

U.S. PATENT DOCUMENTS 3,106,713 A 10/1963 Murata et al.
3,795,915 A 3/1974 Yoshida (Continued)

FOREIGN PATENT DOCUMENTS

WO 2005/014757 A2 2/2005

OTHER PUBLICATIONS

Cameron, Trevor R., et al.; "A Circularly Polarized Broadside Radiating "Herringbone" Array Design With the Leaky-Wave Approach"; IEEE Antennas and Wireless Propagation Letters, 2010, vol. 9, pp. 826-829.

(Continued)

*Primary Examiner* — Joseph Lauture

(57) ABSTRACT

A system for in-situ heating of a subsurface formation for the extraction of hydrocarbons in underground deposits is disclosed. The system is configured to heat the underground deposit of hydrocarbons to facilitate fluid flow and hydrocarbon recovery from the underground deposit. The system has an antenna formed from a coaxial transmission line having an annular space between the transmission line outer conductor and the inner conductor and having one or more periodic aperture arrangements along the axial length of the outer conductor. A method for in-situ heating of a subsurface formation for recovering hydrocarbons contained therein is also disclosed. The method comprises: providing an antenna in the subsurface formation; providing electromagnetic RF power to the antenna for heating at least a portion of the subsurface formation.

20 Claims, 6 Drawing Sheets

Related U.S. Application Data application No. 13/837,120, filed on Mar. 15, 2013, now Pat. No. 9,284,826.

(60) Provisional application No. 62/015,745, filed on Jun. 23, 2014.

(51) Int. Cl.

| | |
|---|---|
| ***H01Q 1/04*** | (2006.01) |
| ***H01Q 9/22*** | (2006.01) |
| ***H01Q 13/20*** | (2006.01) |
| *H01Q 9/30* | (2006.01) |
| *H01Q 19/10* | (2006.01) |
| *H01Q 1/12* | (2006.01) |
| *H01Q 9/26* | (2006.01) |
| *H01Q 21/24* | (2006.01) |
| *H01Q 1/38* | (2006.01) |

(52) U.S. Cl.
CPC ..... *H01Q 13/203* (2013.01); *H01Q 1/1271* (2013.01); *H01Q 1/38* (2013.01); *H01Q 9/26* (2013.01); *H01Q 9/285* (2013.01); *H01Q 9/30* (2013.01); *H01Q 19/10* (2013.01); *H01Q 21/24* (2013.01); *Y10T 29/49016* (2015.01)

(58) Field of Classification Search
USPC ..... 343/795, 750, 834, 850, 810, 713, 803
See application file for complete search history.

(56) References Cited

U.S. PATENT DOCUMENTS

| | | | |
|---|---|---|---|
| 3,860,934 | A | 1/1975 | Cheo |
| 3,995,274 | A | 11/1976 | Schwartz |
| 4,140,179 | A | 2/1979 | Kasevich et al. |
| 4,487,257 | A | 12/1984 | Dauphine |
| 4,508,168 | A | 4/1985 | Heeren |
| 4,576,231 | A | 3/1986 | Dowling |
| 4,583,589 | A | 4/1986 | Kasevich |
| 4,620,593 | A | 11/1986 | Haagensen |
| 4,660,007 | A | 4/1987 | Edwards et al. |
| 4,755,827 | A | 7/1988 | Stern |
| 5,152,341 | A | 10/1992 | Kasevich |
| 5,157,393 | A | 10/1992 | Fox et al. |
| 5,293,936 | A | 3/1994 | Bridges |
| 5,829,519 | A | 11/1998 | Uthe |
| 6,005,520 | A | 12/1999 | Nalbandian |
| 6,051,018 | A | 4/2000 | Larsen |
| 6,166,693 | A | 12/2000 | Nalbandian |
| 6,285,325 | B1 | 9/2001 | Nalbandian |
| 6,340,951 | B1 | 1/2002 | Sheen |
| 6,404,390 | B2 | 6/2002 | Sheen |
| 6,445,354 | B1 | 9/2002 | Kunysz |
| 6,597,323 | B2 | 7/2003 | Teshirogi |
| 6,839,030 | B2 | 1/2005 | Noujeim |
| 7,002,517 | B2 | 2/2006 | Noujeim |
| 7,071,888 | B2 | 7/2006 | Sievenpiper |
| 7,109,928 | B1 | 9/2006 | Thiele |
| 7,170,294 | B2 | 1/2007 | Kasevich |
| 7,253,780 | B2 | 8/2007 | Sievenpiper |
| 7,486,248 | B2 | 2/2009 | Halek et al. |
| 7,705,733 | B2 | 4/2010 | Tethrake |
| 7,714,719 | B2 | 5/2010 | Duff |
| 7,872,616 | B2 | 1/2011 | Choi |
| 7,916,094 | B2 | 3/2011 | Neto |
| 7,956,818 | B1 | 6/2011 | Hsu et al. |
| 7,982,681 | B2 | 7/2011 | Chang |
| 8,059,050 | B1 | 11/2011 | Johnson |
| 8,174,459 | B2 | 5/2012 | Chen |
| 8,202,270 | B2 | 6/2012 | Rossetto |
| 8,242,957 | B2 | 8/2012 | Rofougaran |
| 8,246,615 | B2 | 8/2012 | Behnke |
| 8,253,642 | B2 | 8/2012 | Chang |
| 8,285,231 | B2 | 10/2012 | Rofougaran |
| 8,295,788 | B2 | 10/2012 | Rofougaran |
| 8,301,092 | B2 | 10/2012 | Rofougaran |
| 8,314,744 | B2 | 11/2012 | Libonati et al. |
| 8,320,856 | B2 | 11/2012 | Rofougaran |
| 8,378,764 | B2 | 2/2013 | Suzuki et al. |
| 8,421,698 | B2 | 4/2013 | Neto |
| 8,422,967 | B2 | 4/2013 | Rofougaran |
| 8,432,326 | B2 | 4/2013 | Rofougaran |
| 8,436,318 | B2 | 5/2013 | Sinclair |
| 8,447,250 | B2 | 5/2013 | Rofougaran |
| 8,457,581 | B2 | 6/2013 | Rofougaran |
| 8,508,422 | B2 | 8/2013 | Rofougaran |
| 8,521,106 | B2 | 8/2013 | Rofougaran |
| 8,570,238 | B2 | 10/2013 | Wansch |
| 8,577,314 | B2 | 11/2013 | Rofougaran |
| 8,588,686 | B2 | 11/2013 | Rofougaran |
| 8,608,731 | B2 | 12/2013 | Rossetto |
| 8,616,273 | B2 | 12/2013 | Trautman |
| 8,618,937 | B2 | 12/2013 | Rofougaran |
| 8,660,500 | B2 | 2/2014 | Rofougaran |
| 8,660,505 | B2 | 2/2014 | Rofougaran |
| 8,666,335 | B2 | 3/2014 | Rofougaran |
| 8,701,760 | B2 | 4/2014 | Parsche |
| 8,743,002 | B2 | 6/2014 | Rofougaran |
| 8,761,669 | B2 | 6/2014 | Rofougaran |
| 8,763,692 | B2 | 7/2014 | Parsche |
| 8,766,864 | B2 | 7/2014 | Rofougaran |
| 8,776,877 | B2 | 7/2014 | Trautman |
| 8,787,997 | B2 | 7/2014 | Rofougaran |
| 8,811,923 | B2 | 8/2014 | Rofougaran |
| 8,831,540 | B2 | 9/2014 | Rofougaran |
| 8,836,594 | B2 | 9/2014 | Rothwell |
| 8,843,061 | B2 | 9/2014 | Rofougaran |
| 8,849,194 | B2 | 9/2014 | Rofougaran |
| 8,849,214 | B2 | 9/2014 | Rofougaran |
| 8,887,810 | B2 | 11/2014 | Parsche |
| 8,929,841 | B2 | 1/2015 | Rofougaran |
| 8,937,577 | B2 | 1/2015 | Neto |
| 8,942,659 | B2 | 1/2015 | Gulati |
| 8,958,768 | B2 | 2/2015 | Rofougaran |
| 8,983,386 | B2 | 3/2015 | Rofougaran |
| 8,995,937 | B2 | 3/2015 | Rofougaran |
| 9,004,170 | B2 | 4/2015 | Parsche |
| 9,004,171 | B2 | 4/2015 | Parsche |
| 9,013,311 | B2 | 4/2015 | Rofougaran |
| 9,057,259 | B2 | 6/2015 | Dittmer |
| 9,284,826 | B2 | 3/2016 | Campbell et al. |
| 2002/0000936 | A1 | 1/2002 | Sheen |
| 2002/0005807 | A1 | 1/2002 | Sheen |
| 2002/0067315 | A1 | 6/2002 | Kunysz |
| 2003/0098815 | A1 | 5/2003 | Teshirogi |
| 2004/0227664 | A1 | 11/2004 | Noujeim |
| 2004/0227668 | A1 | 11/2004 | Sievenpiper |
| 2005/0012667 | A1 | 1/2005 | Noujeim |
| 2006/0187126 | A1 | 8/2006 | Sievenpiper |
| 2007/0108202 | A1 | 5/2007 | Kinzer |
| 2007/0159336 | A1 | 7/2007 | Tethrake |
| 2008/0266197 | A1 | 10/2008 | Neto |
| 2010/0156740 | A1 | 6/2010 | Chang |
| 2010/0194652 | A1 | 8/2010 | Chiang |
| 2010/0217252 | A1 | 8/2010 | Rossetto |
| 2010/0218940 | A1 | 9/2010 | Parsche |
| 2010/0308651 | A1 | 12/2010 | Rofougaran |
| 2010/0308668 | A1 | 12/2010 | Rofougaran |
| 2010/0308767 | A1 | 12/2010 | Rofougaran |
| 2010/0308885 | A1 | 12/2010 | Rofougaran |
| 2010/0308970 | A1 | 12/2010 | Rofougaran |
| 2010/0308997 | A1 | 12/2010 | Rofougaran |
| 2010/0309040 | A1 | 12/2010 | Rofougaran |
| 2010/0309052 | A1 | 12/2010 | Rofougaran |
| 2010/0309056 | A1 | 12/2010 | Rofougaran |
| 2010/0309069 | A1 | 12/2010 | Rofougaran |
| 2010/0309071 | A1 | 12/2010 | Rofougaran |
| 2010/0309072 | A1 | 12/2010 | Rofougaran |
| 2010/0309073 | A1 | 12/2010 | Rofougaran |
| 2010/0309074 | A1 | 12/2010 | Rofougaran |
| 2010/0309075 | A1 | 12/2010 | Rofougaran |
| 2010/0309076 | A1 | 12/2010 | Rofougaran |
| 2010/0309077 | A1 | 12/2010 | Rofougaran |

(56) References Cited

U.S. PATENT DOCUMENTS

| | | | |
|---|---|---|---|
| 2010/0309078 | A1 | 12/2010 | Rofougaran |
| 2010/0309079 | A1 | 12/2010 | Rofougaran |
| 2010/0309824 | A1 | 12/2010 | Rofougaran |
| 2010/0311324 | A1 | 12/2010 | Rofougaran |
| 2010/0311332 | A1 | 12/2010 | Roufougaran |
| 2010/0311333 | A1 | 12/2010 | Rofougaran |
| 2010/0311338 | A1 | 12/2010 | Rofougaran |
| 2010/0311340 | A1 | 12/2010 | Rofougaran |
| 2010/0311355 | A1 | 12/2010 | Rofougaran |
| 2010/0311356 | A1 | 12/2010 | Rofougaran |
| 2010/0311359 | A1 | 12/2010 | Rofougaran |
| 2010/0311363 | A1 | 12/2010 | Rofougaran |
| 2010/0311364 | A1 | 12/2010 | Rofougaran |
| 2010/0311367 | A1 | 12/2010 | Rofougaran |
| 2010/0311368 | A1 | 12/2010 | Rofougaran |
| 2010/0311369 | A1 | 12/2010 | Rofougaran |
| 2010/0311376 | A1 | 12/2010 | Rofougaran |
| 2010/0311379 | A1 | 12/2010 | Rofougaran |
| 2010/0311380 | A1 | 12/2010 | Rofougaran |
| 2010/0311472 | A1 | 12/2010 | Rofougaran |
| 2011/0006055 | A1 | 1/2011 | Diehl |
| 2011/0037675 | A1 | 2/2011 | Chen |
| 2011/0148727 | A1 | 6/2011 | Chang |
| 2011/0240876 | A1 | 10/2011 | Sinclair |
| 2011/0241972 | A1 | 10/2011 | Wansch |
| 2011/0248898 | A1 | 10/2011 | Rothwell |
| 2012/0018140 | A1 | 1/2012 | Parsche |
| 2012/0067580 | A1 | 3/2012 | Parsche |
| 2012/0088459 | A1 | 4/2012 | Neto |
| 2012/0118565 | A1 | 5/2012 | Trautman |
| 2012/0125607 | A1 | 5/2012 | Parsche |
| 2012/0259328 | A1 | 10/2012 | Rossetto |
| 2012/0262356 | A1 | 10/2012 | Nguyen |
| 2012/0274524 | A1 | 11/2012 | Piazza |
| 2012/0305239 | A1 | 12/2012 | Sultenfuss |
| 2012/0318498 | A1 | 12/2012 | Parsche |
| 2013/0072138 | A1 | 3/2013 | Rofougaran |
| 2013/0072141 | A1 | 3/2013 | Rofougaran |
| 2013/0095774 | A1 | 4/2013 | Gulati |
| 2013/0153210 | A1 | 6/2013 | Menard |
| 2013/0172729 | A1 | 7/2013 | Kocaturk |
| 2013/0201068 | A1* | 8/2013 | Alexopoulos ..... H01Q 15/0006 343/750 |
| 2013/0208608 | A1 | 8/2013 | Piazza |
| 2013/0237163 | A1 | 9/2013 | Rofougaran |
| 2013/0237166 | A1 | 9/2013 | Rofougaran |
| 2013/0252566 | A1 | 9/2013 | Rofougaran |
| 2013/0259143 | A1 | 10/2013 | Rofougaran |
| 2013/0284429 | A1 | 10/2013 | Parsche |
| 2013/0284430 | A1 | 10/2013 | Parsche |
| 2013/0328739 | A1 | 12/2013 | Rofougaran |
| 2013/0336423 | A1 | 12/2013 | Rofougaran |
| 2014/0028329 | A1 | 1/2014 | Nennie |
| 2014/0076556 | A1 | 3/2014 | Trautman |
| 2014/0080425 | A1 | 3/2014 | Rofougaran |
| 2014/0085126 | A1 | 3/2014 | Rofougaran |
| 2014/0110395 | A1 | 4/2014 | Parsche |
| 2014/0131044 | A1 | 5/2014 | Parsche |
| 2014/0151028 | A1 | 6/2014 | Parsche |
| 2014/0202686 | A1 | 7/2014 | Trautman |
| 2014/0216724 | A1 | 8/2014 | Dittmer |
| 2014/0216725 | A1 | 8/2014 | Dittmer |
| 2014/0216726 | A1 | 8/2014 | Dittmer |
| 2014/0266951 | A1 | 9/2014 | Okoniewski |
| 2014/0290934 | A1 | 10/2014 | Parsche |
| 2014/0300520 | A1 | 10/2014 | Nguyen |
| 2014/0311739 | A1 | 10/2014 | Menard |
| 2014/0347234 | A1 | 11/2014 | Caloz |
| 2015/0007974 | A1 | 1/2015 | Parsche |
| 2015/0013967 | A1 | 1/2015 | Parsche |
| 2015/0022407 | A1 | 1/2015 | Piazza |
| 2015/0034303 | A1 | 2/2015 | Parsche |
| 2015/0034304 | A1 | 2/2015 | Parsche |
| 2015/0114645 | A1 | 4/2015 | Parsche |
| 2015/0117687 | A1 | 4/2015 | Shcherbatko |
| 2015/0129202 | A1 | 5/2015 | Wright |
| 2015/0129222 | A1 | 5/2015 | Wright |
| 2015/0129223 | A1 | 5/2015 | Wright |
| 2015/0129224 | A1 | 5/2015 | Wright |
| 2015/0140938 | A1 | 5/2015 | Gulati |

OTHER PUBLICATIONS

Chiao, J.C., et al.; "An Electronically Switchable Leaky-Wave Antenna"; Article downloaded from www.uta.edu/faculty/jcchio/leaky.htm, pp. 1-7.

"Leaky Wave Antenna"; downloaded from Wikipedia, the free encyclopedia, pp. 1-8.

Oliner, Arthur A., et al.; "Leaky-Wave Antennas", Chapter 11, 55 pages (no pages numbers.

Sutinjo, Adrian, et al.; "Radiation from Fast and Slow Traveling Waves"; IEEE Antennas and Propagation Magazine, vol. 50, No. 4, Aug. 2008, pp. 175-181.

Vaca, Pedro, et al.; "The Application of Radio Frequency Heating Technology for Heavy Oil and Oil Sands Production"; Acceleware Whitepaper: Version 1.0, Jun. 2014, pp. 1-29.

Wacker, Bernd, et al.; "Electromagnetic Heating for In-Situ Production of Heavy Oil and Bitumen Reservoirs"; CSUG/SPE 148932, Nov. 2011, pp. 1-14.

* cited by examiner

SYSTEM FOR EXTRACTION OF HYDROCARBONS UNDERGROUND

CROSS REFERENCE TO RELATED APPLICATIONS

This application claims benefit under 35 USC 119 of U.S. Provisional Patent Application No. 62/015,745 with a filing date of Jun. 23, 2014. This application is a continuation-in-part of U.S. patent application Ser. No. 13/838,783 and U.S. patent application Ser. No. 13/837,120 both with a filing date of Mar. 15, 2013. This application claims priority to and benefits from the foregoing, the disclosures of which are incorporated herein by reference.

FIELD OF THE INVENTION

The invention relates to systems and methods for heating subterranean formation using RF (radio frequency) heating.

BACKGROUND

Considerable effort and advanced technology is being applied to recovering a maximum amount of oil from subsurface formations. In even the most permeable reservoirs, a residual quantity of oil remains on the inorganic matrix of the reservoir after all of the recoverable oil is removed. Reservoirs that contain very heavy and viscous oil, including oil that will not flow at any reasonable recoverable rate at the temperature and pressure of the reservoir, retain even more oil after the easily recoverable material is produced. Tight shales, oil shales, and other largely impermeable rock formations are also difficult to produce. Considering the rapidly decreasing amount of easily accessible reservoir hydrocarbons on earth today, it remains a growing challenge to access and produce hydrocarbons that were not previously available for commercial production.

Improved oil recovery methods, including water flooding, chemically enhanced, and thermally enhanced oil recovery (TEOR), such as by steam flooding, have greatly expanded the number of known oil-containing reservoirs that may be produced in commercial quantities. Enhanced oil recovery methods involving solvents other than water, some with carefully designed surfactants for dislodging residual oil from clay granules in the inorganic matrix of the reservoir, are even more effective for removing remaining traces of oil from reservoirs.

One disadvantage of the more complex steam and chemically enhanced methods is the cost of materials and processing in utilizing these methods. A second disadvantage with all of these improved recovery methods is the limited extent to which they can actively improve the transport properties of oil from formations that have low permeability. Each requires providing fluid (liquid, gas or vapor) access to the formation in order to introduce the chemicals or steam that serve to improve the transport properties of the oil in the formation. Thermal methods, as well, depend largely on heat conduction through a fluid-filled rock matrix. Particularly in a rock matrix having low permeability, such thermal methods are inefficient for improving the transport properties of oil from the matrix. Radiation of energy via radio frequency and microwave frequency from an antenna in a wellbore has been studied for many years (see, for example, U.S. Pat. No. 5,293,936). But, applying antenna designs that were developed for communication in air to subsurface reservoir heating design has proven to be difficult. Most antennas are designed to operate in a low-loss environment having low relative electrical permittivity and little or no electrical conductivity, such as in the Earth's atmosphere.

The typical considerations applied to antenna designs that are intended to be used in a low-loss environment such as free space do not apply to antennas intended to be used in a lossy environment such as underground. In other words, an antenna designed to operate in free space will operate very differently when placed in a lossy environment. Therefore, there is a need for antennas specifically designed to operate within the lossy environment in order to achieve the desired performance characteristics.

Antennas designed to operate in free space (or in a terrestrial based system in air) are typically designed to achieve a desired far field radiation pattern to accomplish communication goals (radio) or for detection purposes (radar). The primary design considerations are often directed to obtaining a desirable operational bandwidth, impedance characteristics, as well as directionality of radiated energy (expressed by far field radiation pattern). Penetration depth (the distance over which electric field of a plane wave is reduced to 1/e of its initial value) in air is hundreds, or thousands or millions (and more) of times the wavelength of the propagating wave.

Numerous investigators have published research results on using electromagnetic methods for enhanced oil recovery. However, the application of electromagnetic methods to subsurface formations has generally been plagued by the development of uneven heating of the wellbore and formation rock immediately adjacent the wellbore. Some attention has been paid to the problem of non-uniform heating of formation rock using electromagnetic methods. For example, Bridges, in U.S. Pat. No. 5,293,936 attempted to resolve the uneven heating problem when using a monopole or dipole antenna-like apparatus by modifying edge and power input regions to purportedly achieve equal distribution of electric fields. More recently, Kinzer, in US20070108202A1, suggested switching out different electrode element pairs for moments of time or possibly providing different field strengths to different portions of the formation or stratification to achieve more uniform heating of the formation.

There is still a need for improved antenna design to meet the challenges of heating lossy environments using electromagnetic waves.

SUMMARY

In one aspect, the invention relates to an antenna and a process for employing the antenna is provided for transmitting radio frequency (RF) electromagnetic radiation into a hydrocarbon-bearing formation to heat the formation to either produce hydrocarbon resources or to increase the rate of production of liquid and/or gaseous hydrocarbons from the formation. The antenna is generally located within a wellbore that extends into a hydrocarbon-bearing formation. The antenna may be located within the wellbore and within the hydrocarbon-bearing formation or it may be located above, or below, the hydrocarbon-bearing formation.

The antenna is a coaxial antenna having an inner conductor, an outer conductor and an annular space there between filled with a dielectric material. The coaxial antenna is comprised of components which constitute a coaxial transmission line, from which the antenna is formed when one or more desired apertures are produced in the outer conductor. In embodiments, the conductor arrangement comprises rigid conductor assemblies. In embodiments, the conductors comprise a flexible cable assembly. In embodiments, the dielectric material within the annular space is a gaseous dielectric. In embodiments, the dielectric material within the annular space is a dielectric fluid. In embodiments, the dielectric material within the annular space is a solid dielectric. In embodiments, the dielectric material within the annular space is a combination of one or more solid dielectric layers and a surrounding dielectric fluid.

The antenna is designed to emit EM radiation, at one or more physical locations along its length, where reservoir heating is desired for the purpose of hydrocarbon recovery. The EM radiation is designed to produce the desired level of reservoir heating within the reservoir structure. Embodiments of the design include the ability to alter the level of EM radiation to achieve varying levels of reservoir heating in order to control either or both the magnitude of temperature rise and the rate of temperature rise. This is intended to address both the operational requirements as well as ensure a capability to not exceed material temperature limit conditions. The use of different materials of construction will result in different values of temperature limitation. Materials suitable for operation at temperatures from 90° C. to 350° C. are required.

The outer conductor comprises a conductive material. In some embodiments, the outer conductor comprises a dielectric material, to which a conductive layer is applied. In embodiments, the outer conductor, or the conductive layer if present, includes at least one aperture that is transparent to RF radiation and which serves to emit EM radiation which heats the reservoir formation. In embodiments, at least one aperture is a radial aperture. In embodiments, at least one aperture is located in the outer conductor at a pitch angle $\alpha$ that is in a range from 5° to 85° from the cross section diameter of the outer conductor. In embodiments, the at least one aperture is a helical aperture. In embodiments, the helical aperture has a length in a range from 0.2 to 15 helical windings around the outer conductor. In embodiments, the aperture may be longitudinal. In embodiments, the aperture has a length in a range from 0.1 meters to 10 meters.

In some embodiments, a plurality of apertures is located along the longitudinal axis of the outer conductor, constituting a periodic arrangement of apertures. In embodiments, the aperture is sealed with a dielectric material to prevent flow of fluid through the aperture. Sealing the aperture may involve coating the outside of the outer conductor with a dielectric material.

In some embodiments, the outer conductor is a metallic pipe, to which a dielectric layer may or may not be applied. In some embodiments, the outer conductor may consist of sections of metallic pipe, connected together in a continuous fashion. In some embodiments, the outer conductor is comprised of a continuous tubular section of metallic pipe. The inner conductor comprises a conductive material. In some embodiments, the inner conductor comprises a dielectric material, to which a conductive layer is applied. In some embodiments, the inner conductor is a solid cylindrical conductor. In some embodiments, the inner conductor is a hollow tubular conductor having a circular cross-section. In some embodiments, the hollow tubular conductor is used to circulate dielectric fluid for the purpose of cooling the antenna and transmission line conductors. In some embodiments, the inner conductor is a hollow conduit for conducting production fluids to the surface and for providing fluids to the wellbore. In some embodiments, the inner conductor comprises a plurality of individual conductors, e.g., from two (2) to nineteen (19) conductors.

In some embodiments, the outer and inner conductors are constructed for the antenna to have a flexible cable configuration.

The antenna receives excitation from a RF signal generator and is delivered from the RF signal generator to the antenna via a transmission line. The RF signal generator supplies a harmonic time-varying sinusoidal waveform with either a single frequency (single mode) or with multiple frequencies (multi-mode), enabling operation in either resonant or traveling wave conditions to achieve the desired EM radiation. In some embodiments, a fast traveling wave combined with the apertures achieves the desired EM radiation which produces reservoir heating in the conductive dielectric material in the reservoir formation.

The transmission line may comprise an arrangement of parallel conductors, coaxial conductors, or some other such conductor arrangement suitable for the transmission of the RF signal from the location of the RF signal generator to the excitation point of the coaxial antenna. The transmission line may be comprised of either a rigid conductor assembly or of a flexible cable assembly. Transmission line dielectric material suitable for the application conditions will be applied. The transmission line may or may not include features to facilitate cooling of the transmission line to maintain suitable operating temperatures for the conductors and surrounding dielectric material.

DRAWINGS

FIG. 2A represents a perspective view and FIG. 2B represents an end view.

Figure 3A:
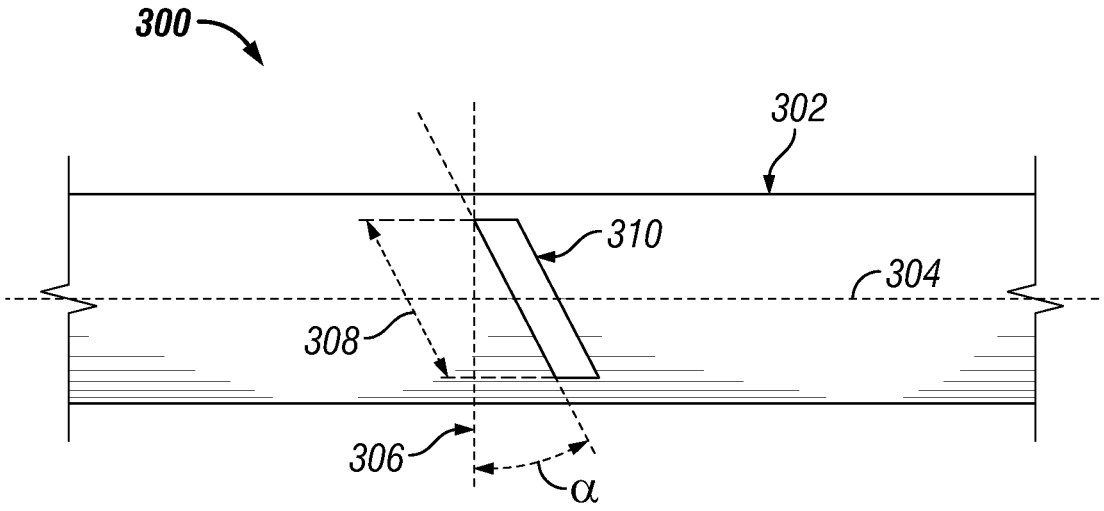
Figure 3B:
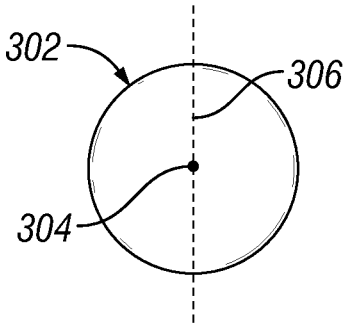

FIGS. 3A & 3B are schematic representations of a coaxial antenna having at least one aperture positioned on the outer conductor at a pitch angle $\alpha$ from the cross section diameter of the outer conductor. FIG. 3A is a side view of the generalized representation of an outer conductor; FIG. 3B is the corresponding end view.

Figure 4A:
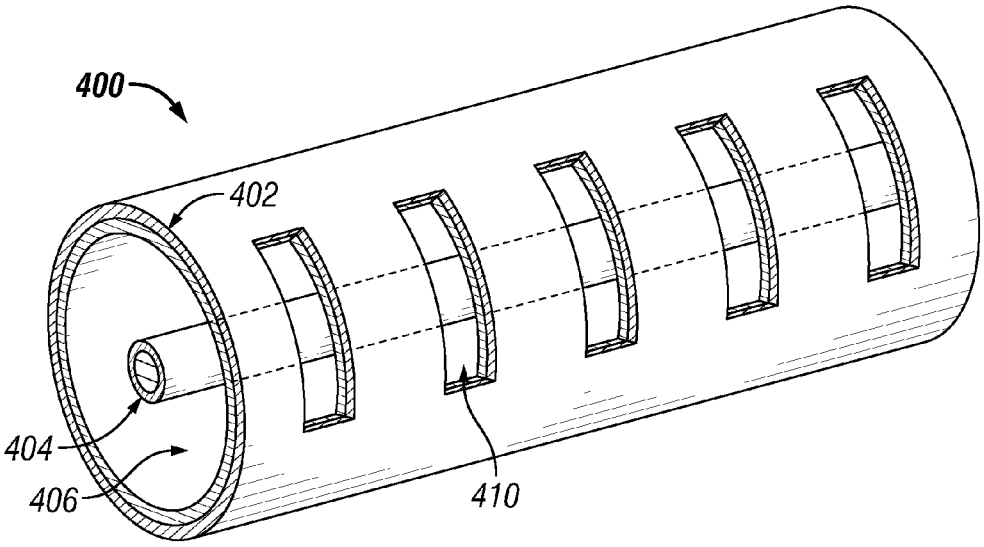
Figure 4B:
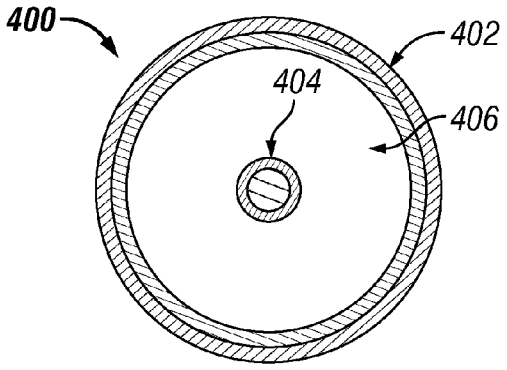
Figure 4C:
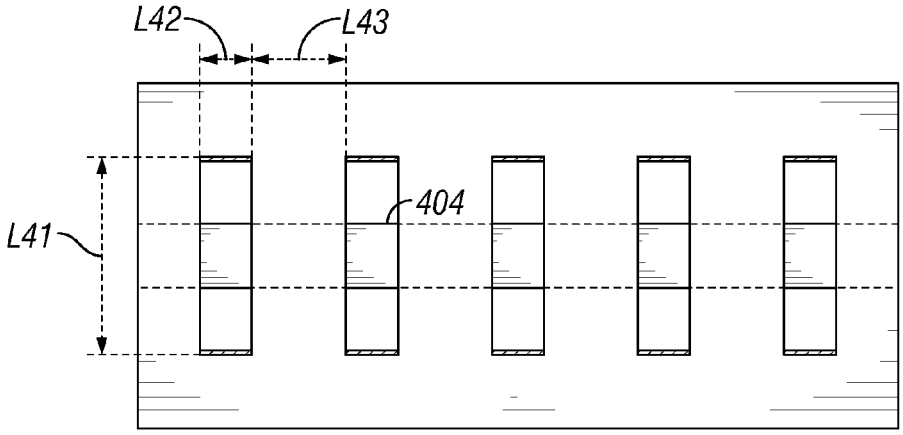

FIGS. 4A, 4C & 4B are schematic representations of a coaxial antenna having at least one radial aperture. FIG. 4A illustrates a plan view of antenna 400; FIG. 4B an end view; and FIG. 4C a side view.

Figure 5:
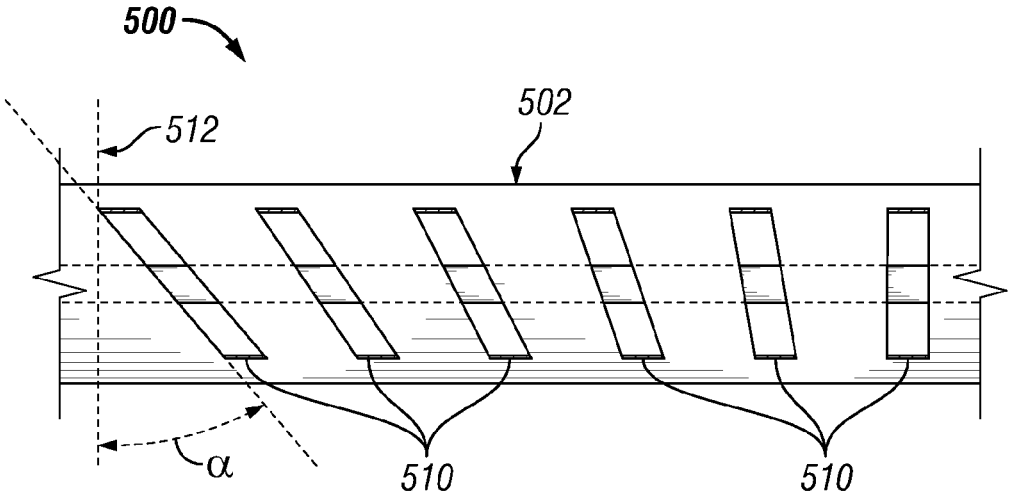

FIG. 5 is a schematic representation of a coaxial antenna having at least one aperture that varies in pitch angle $\alpha$ along a length of an outer conductor of an antenna.

Figure 6A:
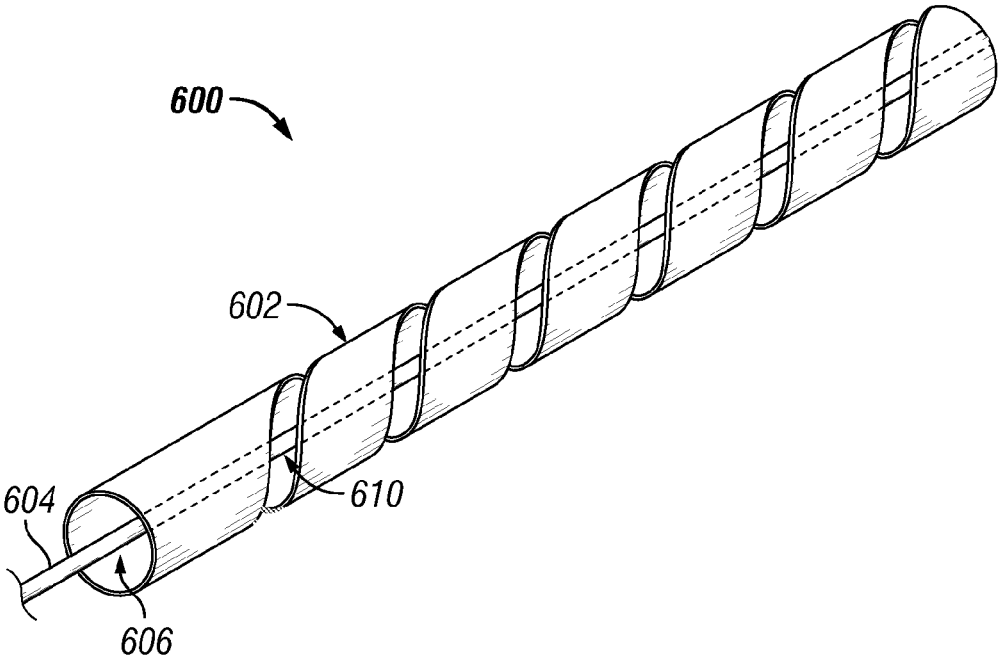
Figure 6B:
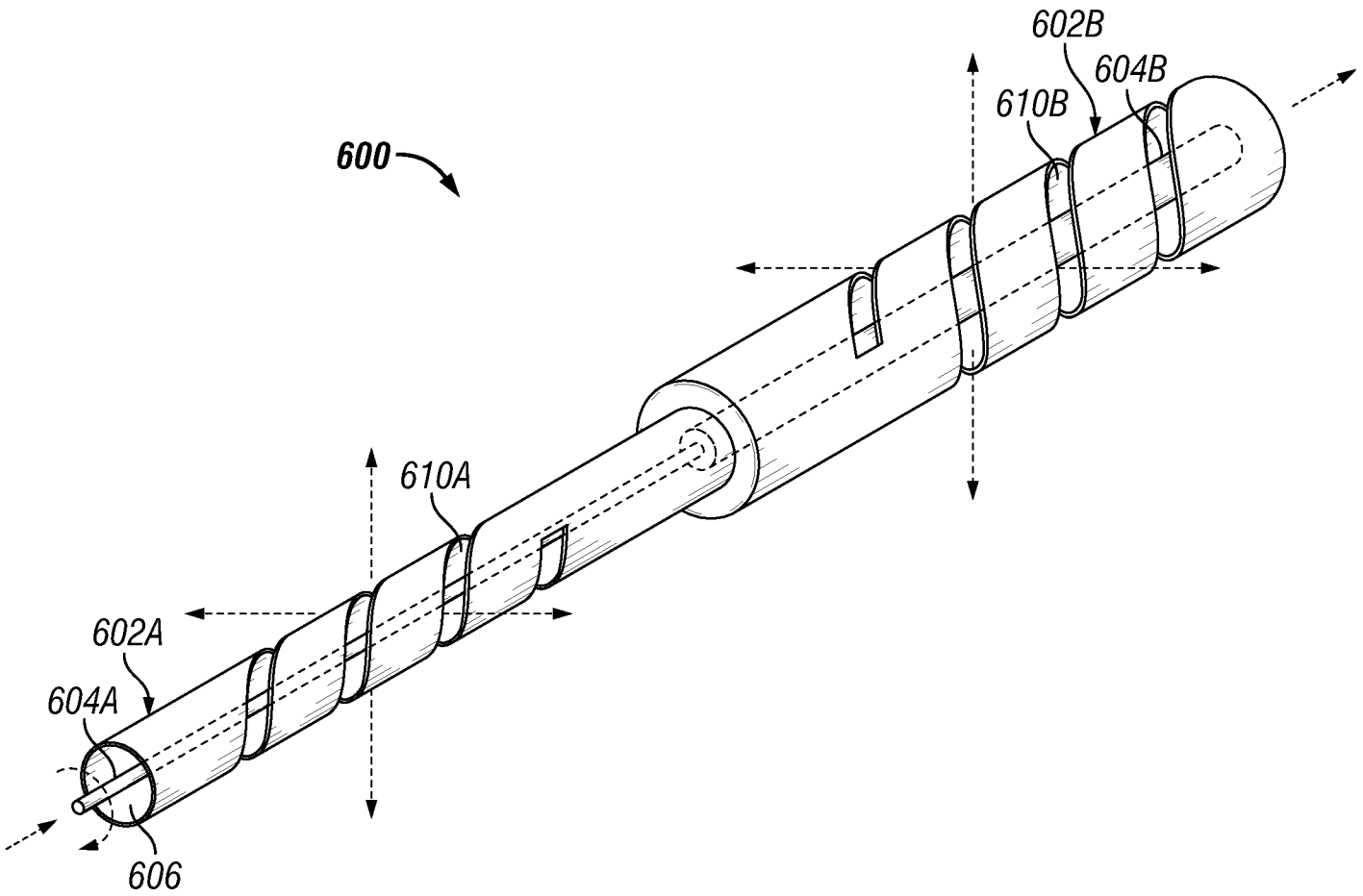

FIGS. 6A and 6B are schematic representations of coaxial antennas with helical aperture configuration. FIG. 6A shows an antenna with one helical aperture, and FIG. 6B shows an antenna with two helical apertures, with the apertures on sections of antenna with different cross-section areas.

DESCRIPTION

The following definitions are provided to aid in understanding the scope of the invention. These definitions are operative in this application unless otherwise indicated.

"Subterranean formation" refers to a subterranean structure comprised of rock matrix of varying inorganic solids, and having porosity. In one embodiment, the subterranean structure comprises an aggregate conductive dielectric material having a relative electrical permittivity ranging from 2.5 to 1000 and an electrical conductivity ranging from 5.0 S/m to $4\times10^{-4}$ S/m. In some examples, subterranean formation refers to reservoirs wherein fluids are contained. The fluids may comprise hydrocarbons such as oil and gas, as well as inorganics such as water which may contain varying proportions of dissolved salts. The properties of the a subterranean formation are understood to have spatial variation derived from the physical arrangement of the materials within, from which aggregate properties are defined and used to establish the EM radiation requirements to achieve the desired heating characteristics (spatially and temporally). It is understood that many of the properties also exhibit a temperature dependency and thus will change over time as the formation heating progresses.

"Conductor" is an object or type of material which permits the flow of electric charges in one or more directions and which is characterized by a high value of electrical conductivity. Metals are examples of materials having high electrical conductivity.

"Aperture" refers to a region void of material having high electrical conductivity, such as a gap or a perforation in the coaxial transmission line forming the coaxial antenna; in one embodiment, in the outer conductor of the coaxial transmission line.

"Surface" refers to the surface of the earth, to a processing facility that is largely located on the earth's surface, or, particularly in water-based environments, including maritime, offshore, ocean-based, or the like environments, to a drilling or production platform.

"Surface facility" means any structure, device, means, service, resource or feature that occurs, exists, takes place or is supported on the surface of the earth.

"Low-permeability hydrocarbon-bearing formation," refers to formations having a permeability of less than about 10 millidarcies, wherein the formations comprise hydrocarbonaceous material. Examples of such formations include, but are not limited to, diatomite, coal, tight shales, tight sandstones, tight carbonates, and the like. The antenna, systems including the antenna and methods using the antenna are suitable for, but not limited to, enhancing hydrocarbon recovery from a low-permeability hydrocarbon-bearing formation.

"Hydrocarbon" refers to solid, liquid or gaseous organic material of petroleum origin, that is principally hydrogen and carbon, with significantly smaller amounts (if any) of heteroatoms such as nitrogen, oxygen and sulfur, and, in some cases, also containing small amounts of metals.

"Hydrocarbon-bearing formation" is a geological, subsurface formation in which hydrocarbons occur and from which they may be produced.

"In-situ" refers to within the subsurface formation.

"Fast wave" describes an EM wave propagating within a transmission line or within the coaxial antenna, and which has phase velocity which is greater than (>) the phase velocity of the EM plane wave propagating within the conductive dielectric material of the reservoir formation (i.e. radiating outside and away from the coaxial antenna).

"Slow wave" is a wave travelling in a transmission line or inside the coaxial antenna with phase velocity slower than a plane wave in the formation, or outside the antenna. "slow wave" describes an EM wave propagating within a transmission line or within the coaxial antenna, and which has phase velocity which is less than (<) the phase velocity of the EM plane wave propagating within the conductive dielectric material of the reservoir formation.

"Transparent" in the context of RF antennas means that a material transmits RF radiation without changing the amplitude or phase of the RF radiation sufficiently to degrade the performance of the system.

"Characteristic impedance" refers to the ratio of the amplitudes of voltage waves and current waves at each location along the length of a transmission line. The value of the characteristic impedance is established by the geometric relationship of the outer and inner conductors, as well as the physical properties of the dielectric material within the inter-conductor space.

"Transverse electromagnetic mode" or TEM refers to a mode of propagation where the electric and magnetic field lines are largely restricted to directions normal (transverse) to the direction of propagation.

"Dielectric constant" refers to the relative electrical permittivity ($\in_r$) of a material. It is understood that the relative electrical permittivity may exhibit a frequency dependency. As used herein, "dielectric constant" refers to the relative electrical permittivity at radio frequencies with which the system intends to operate. Alternatively, one or more samples from the formation, which are recovered, for example, during drilling or well-completion processes, may be analyzed for dielectric constant. A method for determining the dielectric constant of a hydrocarbon-bearing formation involves recovering at least one representative core sample from the hydrocarbon-bearing portion of the formation, and determining the dielectric constant of each sample. A representative relative electrical permittivity for the formation may then be determined as a surface area weighted numerical average of the specific sample determinations, based on the surface area of the wellbore. A numerical model of the formation may be also used to estimate a representative formation relative electrical permittivity, based on measured values for samples collected from the formation.

"Uniform cross-section" refers to a section of antenna where the ratio b/a of the inside diameter of the outer conductor (b) and the outside diameter of the inner conductor (a) is a constant and the outside diameter of the outer conductor is unchanging along the longitudinal axis of the antenna. In one embodiment, the b/a ratio ranges from 1.5 to 10.

"Transmission system" refers to the transmission line and impedance matching circuit elements which are used to deliver the RF signal from the RF signal generator to the antenna.

"Dielectric material" refers to a material that is either intended to function as an electrical insulator or the material that is the subject of the RF heating application, e.g., the subterranean formation. Dielectric material is characterized by the value of its relative electrical permittivity, and may exhibit a frequency dependency. Dielectric material having a relative electrical permittivity that varies with frequency is defined as dispersive. Water is an example of a dispersive dielectric material. This characteristic stems from the fact that water molecules are polar and tend to align with the electric field (i.e. can be polarized by an applied field). The degree of polarization depends on the frequency; at low frequencies alignment occurs readily and the corresponding relative electrical permittivity value is high (~80), at high frequencies alignment is poor and the corresponding relative electrical permittivity value is low (~2). In one embodiment, the dielectric material has a relative electrical permittivity in a range of 1 to 25.

Examples of solid dielectric materials include but are not limited to, for example, alumina, porcelain, glass, glass-resin composites, glass-ceramic composites, PEEK, glass-filled PEEK, ceramic-filled PEEK, PPS, glass-filled PPS, ceramic-filled PPS, PEI, polyethylene PET, glass-filled PEI, ceramic-filled PEI, foamed polymers such as foamed Nylon 6, or other insulating dielectric materials that are hydrocarbon resistant/tolerant and/or compatible with subterranean formation.

Examples of liquid dielectric materials include but are not limited to hydrocarbon liquids, including but not limited to paraffinic waxes and oil, synthetic crude oil such as Fisher Tropsch liquids and solids, purified crude oil, refined crude oil, biodegradable materials, and mixtures thereof.

Examples of gaseous dielectric materials include but not are limited to carbon dioxide, nitrogen, oxygen, a nitrogen-sulfur hexafluoride, air, SF6, and mixtures thereof.

In one aspect, the invention relates to an antenna and a process for employing the antenna is provided for transmitting radio frequency (RF) electromagnetic radiation for subterranean heating, e.g., lossy environment, such as within an oil reservoir, having high (relative to low-loss environment) relative electrical permittivity and electrical conductivity. There are various applications for heating subterranean formation, e.g., in-situ hazardous waste treatment, biological treatment to remove aerobic or anaerobic bacteria, or enhanced oil recovery (EOR). In EOR applications, the formation is heated to increase production of liquid and/or gaseous hydrocarbons from the formation.

The antenna is a coaxial antenna having an inner conductor, an outer conductor and an annular volume (space) there between. The antenna is generally located within a wellbore that extends into a hydrocarbon-bearing formation. The antenna may be located within the wellbore and within the hydrocarbon-bearing formation or it may be located above, or below, the hydrocarbon-bearing formation.

The antenna for heating the subterranean formation includes at least one aperture in an outer conductor of the coaxial transmission line, the aperture being at least partially transparent to RF radiation that is generated by the antenna. Each aperture facilitates electromagnetic power transmission from the antenna to the formation in which the antenna is located. The antenna has an inner conductor that is coaxial to the outer conductor, with an annular space formed by the outer conductor and the inner conductor. The annular space contains a dielectric material having a relative electrical permittivity that is less than the relative electrical permittivity of the subterranean formation.

In one embodiment, the antenna is formed from a single length of conductive material (pipe, tubing, conductor), for an elongated structure with sufficient length to extend into the formation for heating, e.g., a length from 1 meter to 40 meters; or 1 meter to 12 meters, or at least 2 meters, or at least 25 meters. In some embodiments, the antenna has a cross-sectional diameter in a range from 2 cm to 40 cm; in other embodiments, in a range from 2 cm to 25 cm.

In one embodiment, the antenna comprises an elongated structure with a continuous uniform cross-section through the length of the antenna. In other embodiments, the antenna is formed of two or more pieces with uniform cross-section through the length of the antenna and connected together to form the antenna. In another embodiment, the antenna comprises a plurality of sections, each having a continuous uniform cross-section area, but the sections are of different cross-section areas connected together for the antenna to have a step-wise variation in cross-section areas along the length of the antenna.

In one embodiment, the step-wise cross-section area increases through the length of the antenna, with the smallest cross-section area nearest the antenna input (i.e. proximal end) and the largest cross-section area at the distal end of the antenna. By altering the size of the antenna from the proximal to the distal ends allows tailoring the emitted energy for the different underground layers of the formation. In one embodiment, the coaxial antenna has a proximal end adjacent to an electrical input to the antenna and a distil end farthest from the electrical input.

The distribution and size of the apertures can be designed to achieve a desired radiation power profile. In one embodiment there can be fewer and smaller apertures near the heel of the antenna, and progressively more frequent and or bigger apertures near the toe of the antenna to achieve uniform power distribution along the antenna. In other embodiments other profiles may be accomplished as required for a particular formation.

Aperture size and shape affects the radiation, apertures with shapes ranging from rectangular, elliptical, helical, angled, or arbitrary shaped apertures may be considered to achieve a desired radiation pattern. In some embodiments, a plurality of apertures is located along the longitudinal axis of the outer conductor. In some embodiments, the plurality of apertures constitutes a periodic arrangement of apertures. In another embodiment, the plurality of apertures is of the same size. In another embodiment, the apertures are of different sizes. In yet another embodiment, a single helical aperture is provided winding along the length of the outer conductor. In another embodiment, a plurality of apertures are provided with different shapes/sizes on the separate sections of the antenna along the length of the outer conductor of the antenna, e.g., helical aperture, radial aperture, angled aperture, and longitudinal aperture.

In one embodiment, the aperture(s) in the outer conductor are characterized by a pitch, $\alpha$, indexed to the cross section diameter of the outer conductor. In this case, the coaxial antenna is characterized by a longitudinal axis passing along the length of the antenna, the longitudinal axis being equidistant from corresponding points around the cross section circumference of the outer conductor of the antenna. The cross section circumference is associated with a cross section diameter, extending from, and perpendicular to, the longitudinal axis of the outer conductor.

In the lossy environment of a subterranean formation and to improve radiation efficiency, in one embodiment, the apertures in the outer conductor are angled at a pitch angle $\alpha$ from the radial direction. In some embodiments, the pitch angle $\alpha$ of the apertures may vary from 0° (for a radial aperture) to 90° (longitudinal aperture), depending on the requirements of a particular formation. In some embodiments, pitch angle $\alpha$ may vary in a range from 5° to 85°; in some embodiments from 45° to 60°. As pitch angle $\alpha$ approaches 90°, the field coupling from the transmission line to the aperture gets stronger and hence radiates stronger. Therefore, the aperture placement, length, and angle can be varied over the length of the outer conductor to create the desired uniform radiation profile.

In one embodiment, the antenna comprises at least one helical aperture. The helical aperture can be continuous or intermittent along the length of the antenna. In the latter case, the apertures may have uniform or varying lengths. The helix pitch angle, helix direction, aperture width and the distance between the apertures can vary along the length of the antenna, or even within an individual helix.

In one embodiment, the at least one aperture are arranged for the antenna to have full 360 degree circumferential radiation along the aperture's longitudinal axis; an operational power signal frequency from about 5 kHz to about 20 MHz, a radiation power ranging from 0.1 kW/m to 50 kW/m per longitudinal length of the antenna, for the antenna to heat a formation having a relative electrical permittivity ranging from 2.5 to 1000 and electrical conductivity ranging from 5.0 S/m to $4\times10^{-4}$ S/m. In one embodiment, the at least one aperture are arranged for the antenna to have circumferential radiation of at least 180 degrees along the longitudinal axis. In another embodiment, the at least one aperture are arranged for a circumferential radiation of at most 180 degrees along the longitudinal axis.

In some embodiments, the at least one aperture in the outer conductor are sealed to prevent fluid flow into or out of the annular space of the coaxial antenna. In one embodiment, the aperture is sealed with a (solid) dielectric material transparent to electromagnetic radiation, preventing fluid flow through the aperture. In one embodiment, the dielectric material sealing the at least one aperture has a relative electrical permittivity in a range of 1 to 10. Sealing the at least one aperture may involve, for example, filling each aperture with a dielectric material. Alternatively, the outer conductor may be coated with a dielectric material.

Aperture Dimensions:

In some embodiments, the antenna comprises a plurality of helical apertures, each having an angular length of 0.5 radians to 36 radians (i.e. helical windings) per aperture; in some such embodiments, from 1.25 radians to 36 radians per aperture. In some embodiments, each helical aperture is in the range from 0.1 meters to 100 meters in length. In some such embodiments, each helical aperture is in the range from 0.1 meters to 5 meters in length. In one embodiment, the helical aperture extends from the beginning of the antenna to its end. In some embodiments, the antenna includes more than one aperture, with each aperture being distributed in a range of from 1 meter to 15 meters apart along the antenna's length; in some such embodiments from 2 meters to 10 meters apart along the antenna's length. The distance between apertures may be constant, or variable, along the antenna's length. In one embodiment, the antenna has at least two helical apertures that are in a parallel configuration forming a double helix in the outer conductor. In one embodiment, the outer conductor has at least two apertures, a first aperture having a first pitch angle $\alpha_1$ and a second aperture having a second pitch angle $\alpha$, wherein the first pitch angle $\alpha_2$ and the second pitch angle $\alpha$ differs by at least 5° from each other.

Outer Conductor:

The outer conductor in one embodiment comprises at least a tubing member formed from a conductive material. The outer conductor may have cross sections in any of circular, oval, square, rectangular, hexagonal, trigonal, pentagonal, or octagonal form. In one embodiment, the outer conductor cross section is circular. In one embodiment, the conductive material comprises steel or steel alloys, aluminum or aluminum alloys, copper or copper alloys, gold, silver, carbon-fibers, graphene or combinations thereof such as copper-clad steel, alloys or combinations thereof. The outer conductor may also be constructed from steel piping, for example, to provide structural support for the antenna. In one embodiment, the outer conductor is constructed from non-magnetic steel. In another embodiment, the outer conductor is constructed from steel covered (e.g., using cladding) with another conductor either on external surface or internal surface or both.

In one embodiment, the outer conductor is of a (solid) dielectric material with a conductive layer, on one or both surfaces of the outer conductor, with at least one aperture in the conductive layer providing a window for the flow of electromagnetic radiation from the antenna into the hydrocarbon-bearing formation. In one embodiment, the dielectric material is fiberglass. Suitable conductor layer/coatings for use may be a thin film of a conductive material such as, aluminum and aluminum alloys, copper, and copper alloys, or combinations thereof, applied to the wall of the outer conductor using known methods. Alternatively, the conductive layer may be formed from wire that is wound in the outside, or inside, of the wall of the outer conductor. Aperture(s) in the outer conductor will extend through the conductive layer.

In one embodiment, the conductive layer is applied in a thickness that is influenced by the skin depth at operating conditions. Skin depth is a measure of the material thickness through which the current density has fallen to 1/e or 0.37 of its surface value. In some embodiments, the conductive layer on the outer conductor has a minimum thickness in the range from 1 to 10 skin depths; in some such embodiments, in the range from 2 to 5 skin depths.

In one embodiment, the outer conductor comprises a conductive cylinder that is perforated by at least one aperture. In one embodiment, the aperture is sealed with a dielectric material to prevent liquid flow through the aperture. In one embodiment, the outer conductor comprises a dielectric material, such as a fiberglass cylinder, having a conductive coating or layer, either on an inside or an outside surface of the cylinder. At least one aperture is the conductive coating or layer provides a pathway for passage of electromagnetic radiation from the antenna into a subsurface formation.

Inner Conductor:

The antenna is provided with an inner conductor which takes the shape of the outer conductor (thus being "coaxial"). The inner conductor forms an RF transmission line that delivers power to the radiating apertures. During operation of the antenna, periodic loadings may be applied to the inner conductor to increase the phase constant in the transmission line to better couple with radiating apertures, or achieve certain periodic modes with preferred radiation characteristics. For example, periodic loading can be used to achieve backward wave spatial harmonics that will exhibit phase velocity that supports leaky wave radiation mode.

In one embodiment, inner conductor has a hollow central portion that may contribute the meeting weight targets for the antenna, may reduce antenna construction costs in certain situations, and/or may be used as a conduit for supplying fluids to the wellbore or for producing fluids from the wellbore. In some such embodiments, the hollow inner conductor serves as a conduit for alternatively moving fluids to, and from, the wellbore. The outer diameter of inner conductor is dependent upon the desired impedance of the coax cable. Dimensions of the hollow inner conductor may vary, depending on the specific operation. The wall thickness of the hollow inner conductor is desirably sufficient to prevent collapse of the conductor during operation in the wellbore for heating the formation.

Non-limiting examples of inner conductor cross sections include circular, oval, square, rectangular, hexagonal, trigonal, pentagonal, or octagonal. In one embodiment, the inner conductor cross section is circular. The inner conductor comprises a material having electrical conductive properties. In one embodiment, the conductive material comprises steel or steel alloys, aluminum or aluminum alloys, copper or copper alloys, gold, silver, carbon-fibers, graphene or combinations thereof such as copper-clad steel, alloys or combinations thereof. In another embodiment the inner conductor is a steel pipe, or steel pipe covered with another conductor such as copper or aluminum for example using process of cladding. In another embodiment, the inner conductor comprises a (solid) dielectric material, with a conductive coating on the external surface of the inner conductor. Representative conductive materials include aluminum and aluminum alloys, copper, and copper alloys, or combinations thereof.

In one embodiment, the antenna is provided with a helical inner conductor of aluminum, aluminum alloys, copper, copper alloys, or combinations thereof, wrapped around an inner dielectric rod. The helical configuration creates a slow wave structure that may provide a phase delay between the aperture edge voltages between helical apertures.

Annular Space:

An annular space (volume) is formed between the inner conductor and the outer counter. In other embodiments, solid, liquid and gaseous dielectric materials, including combinations of materials, may be included in the annular space. In some embodiments, a dielectric fluid is supplied to the annular space within the antenna through the coaxial cable formed from the conduit and the transmission line.

Recovering Hydrocarbons with RF Heating:

The invention further provides a method for radio frequency in-situ heating of a subsurface formation. In one embodiment, the heating is for recovering hydrocarbons contained therein, using the coaxial antenna in the subsurface formation and providing electromagnetic power to the antenna for heating at least a portion of the subsurface formation. The coaxial antenna is located in a wellbore extending into the subsurface formation. The wellbore can be horizontal, vertical, or inclined. The coaxial antenna is employed in an RF heating system with a generating unit (RF generator) for generating electromagnetic energy of at least one RF frequency. RF power may be supplied to the antenna from the RF generator through a coaxial transmission line attached to the antenna, transmitting electromagnetic energy from the generating unit to the RF antenna.

The coaxial line may have different geometry and materials than the line used to form the antenna. Alternatively, the material used as the conductive layer in the antenna may be used to create the coaxial transmission line. In some instances it might be beneficial to feed the antenna from both ends, at some point along the length of the antenna, or in many points to provide sufficient power.

In one embodiment, practical ranges of impedance of the antenna used to heat oil reservoirs can range from 25 to 80 ohms, e.g. 50 ohms. In one embodiment, the antenna is employed in a system for heating at least a portion of the subsurface formation to a minimum temperature of greater than 60° C. In another embodiment, the antenna is for heating at least a portion of the subsurface formation by at least 20° C. In one embodiment, the system operates to provide electromagnetic power to heat the formation at a rate of 0.1 kW/m to 50 kW/m (m indicates the longitudinal unit length of the antenna.

In one embodiment, the RF generator provides electromagnetic power at a radio frequency in a range from 5 kHz to 20 MHz. In one embodiment, the RF generator operates at a single operating radio frequency within the range from 5 kHz to 20 MHz. In another embodiment, the RF operator operates operates at multi-mode, with at least two harmonic time-varying sinusoidal waveforms, and having different frequencies within the range from 5 kHz to 20 MHz.

The heating phase may create a volume of heated fluid, such as oil and water, that flows from the formation into the wellbore containing the antenna. The produced fluid may be removed from the wellbore as heating is being conducted, using, for example, a sucker rod pump or a downhole submersible pump. In one embodiment, production of the fluid serves to cool the near wellbore region to maintain operating temperatures within specified material temperature limits. In one embodiment, a hollow inner conductor may be included as a portion of the conduit for moving produced fluids from the wellbore to the surface. Heated oil may also flow to a second "producing" wellbore that recovers production fluids to the surface.

Figures Illustrating Embodiments

Reference will be made to the figures to further illustrate embodiments of the invention.

Figure 1:
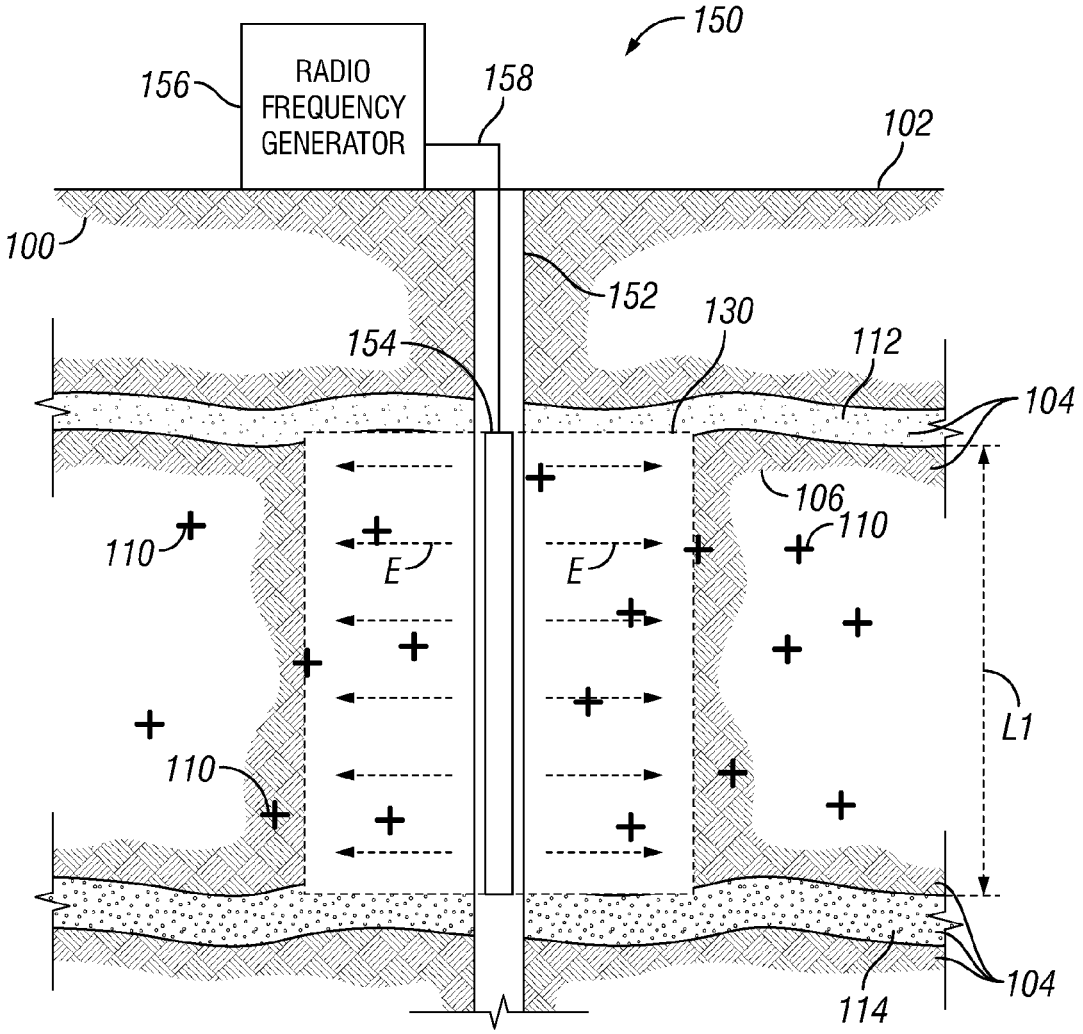
FIG. 1 is a cross-sectional view of a portion of the Earth and further illustrating a subterranean heating system using radio frequency energy.

FIG. 1 is a schematic cross-sectional view of the portion 100 of the Earth and also illustrates at least part of an example oil extraction system 150. In this example, the portion 100 of the Earth includes a surface 102, a plurality of underground layers 104, and a hydrocarbon-bearing formation 106. The hydrocarbon-bearing formation 106 includes oil 110. Also in this example, the part of the oil extraction system 150 includes a wellbore 152, an antenna 154, a radio frequency signal generator 156, and transmission system 158. A first portion 130 of the hydrocarbon-bearing formation 106 is also shown. The transmission system comprises the transmission line and impedance matching circuit elements to effectively deliver the RF signal from the RF signal generator to the antenna. The wellbore comprises loss-of-containment controls required to maintain wellbore integrity before, during, and after RF heating operations.

Oil Bearing Formation:

Typically the hydrocarbon-bearing formation is trapped between layers 104 referred to as overburden 112 and underburden 114. These layers are often formed of a fluid impervious material that has trapped the oil 110 in the hydrocarbon-bearing formation 106. As one example, the overburden 112 and underburden 114 may be formed of a tight shale material.

In this example, the portion 100 of the earth includes the hydrocarbon-bearing formation 106, which includes oil 110. In addition to the oil 110, the hydrocarbon-bearing formation typically also includes additional materials. The materials can include solid, liquid, and gaseous materials. Examples of the solid materials are quartz, feldspar, and clays. Examples of additional liquid materials include water and brine. Examples of gaseous materials include natural gas containing, but not limited to, constituents such as methane, ethane, propane, butane, carbon dioxide, and hydrogen sulfide.

Crude Oil:

The oil 110 is a liquid substance to be extracted from the portion 100 of the Earth. In some embodiments the oil is extra heavy, heavy, medium, and/or light crude oil. In some embodiments, the oil 110 is or includes heavy oil. One measure of the heaviness or lightness of a petroleum liquid is American Petroleum Institute (API) gravity. According to this scale, light crude oil is defined as having an API gravity greater than 31.1° API (less than 870 kg/m3), medium oil is defined as having an API gravity between 22.3° API and 31.1° API (870 to 920 kg/m3), heavy crude oil is defined as having an API gravity between 10.0° API and 22.3° API (920 to 1000 kg/m3), and extra heavy oil is defined with API gravity below 10.0° API (greater than 1000 kg/m3).

Because the oil 110 is intermixed with other materials within the hydrocarbon-bearing formation, and also due to the potentially high viscosity of the oil, it can be difficult to extract the oil from the hydrocarbon-bearing formation. For example, if a well is drilled into the hydrocarbon-bearing formation 106, and pumping is attempted, very little oil is likely to be extracted. The viscosity of the oil 110 causes the oil to flow very slowly, resulting in minimal oil extraction. Viscosity of a hydrocarbon oil is generally an inverse logarithmic function of temperature, thus heating the oil has a tendency to increase the mobility, and thus, recovery of the hydrocarbon fluid, Steam Heating:

An enhanced oil recovery (EOR) technique could also be attempted to heat the formation, e.g., steam is injected into the formation. However, some formations are not receptive to steam injection. The ability of a formation to receive steam is sometimes referred to as steam injectivity. When the formation has poor steam injectivity, little or no steam can be pushed into the formation. The steam may have a tendency to channel along the wellbore, for example, rather than penetrating into the formation 106. Alternatively, the steam may also travel along easily fractured strata or regions of high permeability, thus leading to poor steam injectivity. Accordingly, there is a need for another technique for at least initiating the extraction of oil from the hydrocarbon-bearing formation that does not rely on the initial injection of steam into the formation when the formation has poor steam injectivity.

RF Heating:

Accordingly, one solution is to first heat the first portion 130 of the hydrocarbon-bearing formation using radio frequency (RF) heating, as discussed in further detail below, reducing the viscosity of the oil 110, and causing it to flow more rapidly. A pump (not shown in FIG. 1) of the oil extraction system 150 can then be used to extract the oil 110, opening up voids within the first portion 130 and greatly improving the steam injectivity of the first portion 130 of the hydrocarbon-bearing formation 106. Steam injection can then be performed, for example, to warm and extract oil 110 from additional portions of the hydrocarbon-bearing formation 106, for example. Additional examples of systems and methods for extracting oil using radio frequency heating are described in U.S. Publication Nos. 20140262225 and 20140266951, the disclosures of which are herein incorporated by reference in their entirety.

Wellbore:

Radio frequency heating is initiated by inserting an antenna 154 into the wellbore 152. The oil 110 within a first portion 130 of the hydrocarbon-bearing formation 106 is then heated using radio frequency energy supplied by the radio frequency generator 156. The wellbore 152 is typically formed by drilling through the surface 102 and into the underground layers 104 including at least through the overburden 112, and typically into the hydrocarbon-bearing formation 106. The wellbore 152 can be a vertical, horizontal, or diagonal wellbore, or some combination thereof. In some embodiments, the wellbore includes an outer cement layer surrounding an inner casing. In some embodiments the casing is formed of fiberglass or other RF transparent material. In some cases the wellbore in the region of the antenna in the hydrocarbon-bearing formation may be uncased. Under this condition, the antenna may, or may not, be installed with a surrounding volume containing one or more layers consisting of some combination of cement, gravel, sand or other specified dielectric material within the wellbore. An interior space may be provided inside of the casing of the wellbore 152, permitting the passage of parts of the oil extraction system 150 as well as fluids and steam. In some embodiments, the interior space of the wellbore 152 has a cross-sectional distance in a range from about 10 cm to about 100 cm. Additionally, in some embodiments perforations are formed through the casing and cement to permit the flow of fluid and steam between the hydrocarbon-bearing formation 106 and the interior space of the wellbore 152.

Antenna:

The antenna 154 is a device that converts electric energy into electromagnetic energy, which is radiated in part from the antenna 154 in the form of electromagnetic waves (E, in FIG. 1) and in part forms a reactive electromagnetic field near the antenna. Examples of antenna 154 are illustrated and described in more detail herein. In some embodiments the antenna has a length L1 approximately equal to a dimension of the hydrocarbon-bearing formation 106, such as the vertical depth of the formation 106. For a horizontal wellbore 152, the length L1 can be selected to be equal to a horizontal dimension of the hydrocarbon-bearing formation 106. Longer or shorter lengths can also be used, as desired. In some embodiments, a length L1 of the antenna 154 is in a range from about 30 meters to about 3000 meters. Other embodiments have antennas 154 of other sizes.

The antenna 154 is inserted into the wellbore 152 and lowered into position, such as using a rig (not shown) at the surface 102. Rigs are typically designed to handle pieces having a certain maximum length, such as having a length from 12 meters to 40 meters. In some such embodiments, the antenna can be formed from a single length of conductive material (pipe, tubing, conductor), or formed of two or more pieces having lengths equal to or less than the maximum length. In some embodiments, ends of the antenna pieces are threaded to permit the pieces to be connected together for insertion into the wellbore 152, such that electrical conductivity is maintained through the connection. The antenna is then lowered down into the wellbore until it is positioned within the hydrocarbon-bearing formation 106.

RF Signal Generator:

The RF generator 156 operates to generate RF electric signals that are delivered to the antenna 154. The generator 156 is typically arranged on the surface in the vicinity of the wellbore 152. In some embodiments, the generator 156 includes electronic components, such as a power supply, an electronic oscillator, frequency tuning circuitry, a power amplifier, and an impedance matching circuit. In some embodiments, the generator includes a circuit that measures properties of the generated signal and attached loads, such as for example: power, frequency, as well as the reflection coefficient from the load. For a dipole antenna, the generator 156 is operable to generate electric signals having a frequency inversely proportional to a length L1 of the antenna to generate standing waves within the antenna 154. For example, when the antenna 154 is a half-wave dipole antenna, the frequency is selected such that the wavelength of the electric signal is roughly twice the length L1. In some embodiments the generator 156 generates an alternating current (AC) electric signal having a sine wave.

RF Frequency:

In some embodiments, the frequency or frequencies of the electric signal generated by the RF generator is in a range from about 5 kHz to about 20 MHz, or in a range from about 50 kHz to about 10 MHz. In some embodiments the frequency is fixed at a single frequency. In another possible embodiment, multiple frequencies can be used at the same time. In some embodiments, the frequency may be altered over time in accordance with changing operational conditions or constraints; such as changing reservoir material properties, transmission line and coaxial antenna component operating temperatures, and reservoir heating.

RF Power:

In some embodiments, the RF generator 156 generates an electric signal having a power ranging from about 3 kilowatts to 2 megawatts. In some embodiments, the power is selected to provide minimum amount of power per unit length of the antenna 154. In some embodiments, the minimum amount of power per unit length of antenna 154 is in a range from about 0.5 kW/m to 5 kW/m. Other embodiments generate more or less power.

Transmission Line:

The transmission line 158 provides an electrical connection between the RF generator 156 and the antenna 154, and delivers the RF signals from the generator 156 to the antenna 154. In some embodiments, the transmission line 158 is contained within a conduit that supports the antenna in the appropriate position within the hydrocarbon-bearing formation 106, and is also used for raising and lowering the antenna 154 into place. An example of a conduit is a pipe. One or more insulating materials are included inside of the conduit to separate the transmission line 158 from the conduit. In some embodiments the conduit and the transmission line 158 form a coaxial cable. In some embodiments the conduit is sufficiently strong to support the weight of the antenna 154, which can weigh as much as 2,000-5,000 kg. In some embodiments, the antenna may weigh more, or less.

In some embodiments, once the antenna 154 is properly positioned in the formation, the RF generator 156 begins generating RF signals that are delivered to the antenna 154 through the transmission line 158. The RF signals are converted into electromagnetic energy, which is emitted from the antenna 154 in the form of electromagnetic E-field which produces a near-wellbore reactive field. The electromagnetic E-field passes through the wellbore and into at least a first portion 130 of the hydrocarbon-bearing formation. The electromagnetic E-field causes both conductive and dielectric heating to occur, primarily due to the molecular oscillation of polar molecules present in the first portion 130 of the hydrocarbon-bearing formation 106 caused by the corresponding oscillations of the electromagnetic E-field. The RF heating continues until a desired temperature has been achieved at the outer extents of the first portion 130 of the hydrocarbon-bearing formation 106, which reduces the viscosity of the oil to enhance flow of fluids within the hydrocarbon-bearing formation 106. In some embodiments the power of the electromagnetic energy delivered is varied during the heating process (or intermittently cycled ON and OFF) as needed to achieve a desired heating profile.

Figure 2A:
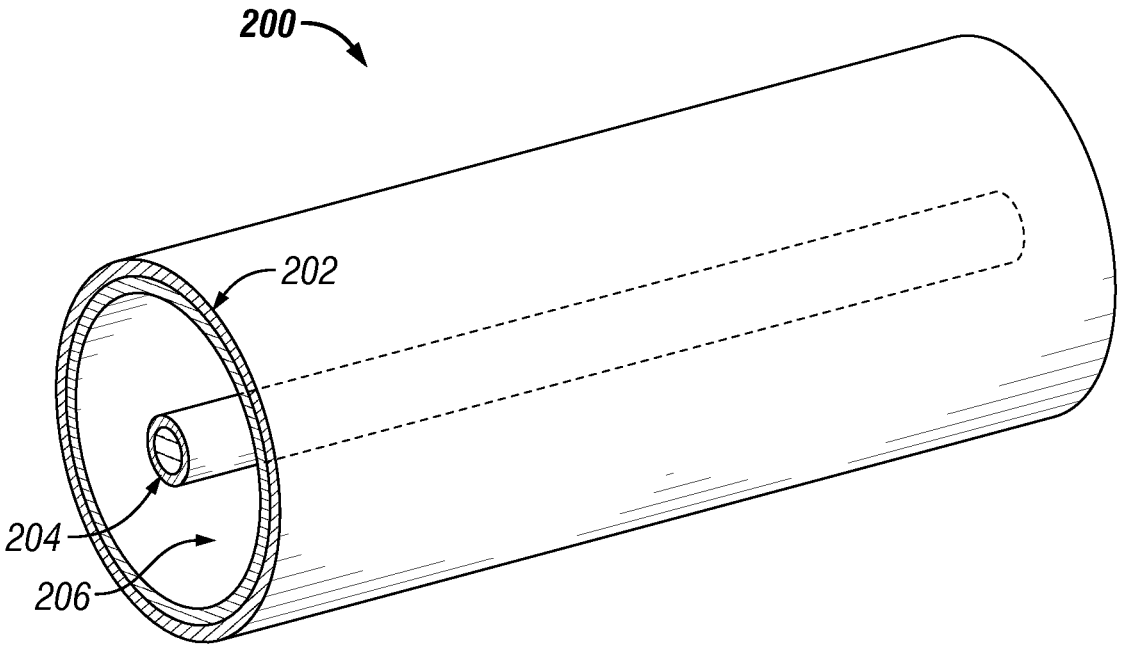
FIGS. 2A & 2B are schematic representations of a coaxial antenna.
Figure 2B:
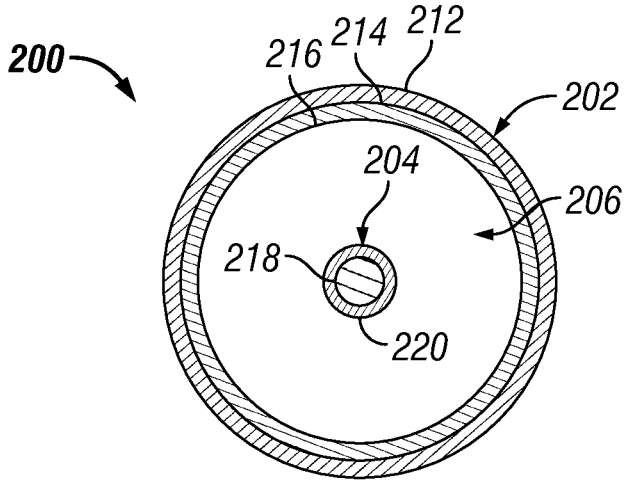

Coaxial Antenna: FIGS. 2A and 2B illustrate an embodiment of the antenna. FIG. 2A represents a perspective view and FIG. 2B represents an end view. In the figures, the antenna 200 is a coaxial antenna, having an outer conductor 202, and inner conductor 204 coaxial to the outer conductor. Annular space 206 is the volume within the antenna 200 between the outer conductor 202 and the inner conductor 204.

The outer conductor 202 of the antenna serves the purpose of transmitting energy from the antenna to the subsurface formation, and of sealing the antenna from fluid intrusion into the annular space from outside the antenna. In one embodiment, the outer conductor 202 is of a dielectric material with a conductive layer 216, either on the internal surface 214, on the external surface 212 of the outer conductor 202, or one both surfaces. The conductive layer 216 is shown as applied to internal surface 214.

The inner conductor 204 is an elongated structure with a uniform cross-section as shown, and with a hollow central portion. The antenna 200 has an overall diameter D1 that is less than or equal to the diameter of the wellbore in which it is placed. The annular space 206 between the outer conductor 202 and the inner conductor 204 is filled, at least partially, with a dielectric material.

FIGS. 3A and 3B illustrate an antenna with at least a helical aperture. The antenna has an outer conductor 302 of antenna 300, having a longitudinal axis 304 and a cross section diameter 306, the pitch a represents the angle between the cross section diameter of the outer conductor and the length dimension 308 of the aperture 310 (the angle relative to the cross sectional area of the outer conductor). FIG. 3A is a side view of the generalized representation of an outer conductor; FIG. 3B is the corresponding end view.

FIGS. 4A, 4B, and 4C illustrate an embodiment of the coaxial antenna 400 having an outer conductor 402, an inner conductor 404 coaxial to the outer conductor. Annular space 406 is the volume within the antenna 400 between the outer conductor 402 and the inner conductor 404. FIG. 4A illustrates a plan view of antenna 400; FIG. 4B an end view; and FIG. 4C a side view. The apertures in the coaxial antenna illustrated in FIG. 4 are radial apertures in the outer conductor 402, where each aperture 410 has a length dimension L41 that is parallel with a cross section diameter of the antenna, and pitch a is equal to zero. The radial apertures may form a uniform aperture pattern, or may vary in some way, along at least a portion of the length of the antenna. Exemplary apertures have length L41 ranging from 2 cm up to one-half times the circumference of the outer conductor. Transverse height of each aperture L42 may be from 0.5 cm to 50 cm, with a longitudinal distance L43 between apertures of from 0.5 cm to 50 cm.

In FIG. 5, antenna 500 having outer conductor 502, illustrates an embodiment showing the variation in sizes and pitch angle $\alpha$ of a number of apertures 510 along a length of the antenna.

In the embodiment illustrated in FIG. 6A, the coaxial antenna 600 having an outer conductor 602, an inner conductor 604, and an annular space 606 is an antenna. The coaxial antenna has a single aperture 610 wraps around the outer conductor in helical fashion. The helical aperture 610 has a length of multiple $\pi$ radians. In FIG. 6B, the coaxial antenna 600 with an annular space 606 comprises two sections for a step-wise change in characteristic impedance. The first section has an outer conductor 602A, and a single aperture 610A wraps around the outer conductor 602A in helical fashion. The second section has an outer conductor 602B and inner conductor 604B with larger cross-sectional areas than the first section's outer and inner conductors respectively. The second section also has a single aperture 610B which wraps around the outer conductor 602B in helical fashion. Both apertures 610A and 610B each has a length of multiple $\pi$ radians·avoidance of doubt, the present application includes the subject-matter defined in the following numbered paragraphs: A system for using radio frequency (RF) in-situ heating of a subterranean formation, the formation having a $1^{st}$ relative electrical permittivity ranging from 2.5 to 1000 and an electrical conductivity ranging from 5.0 S/m to $4\times10^{-4}$ S/m, the system comprises: a wellbore extending into a subterranean formation and having an RF transparent casing in a hydrocarbon-containing region of the subterranean formation; an RF antenna extending into the wellbore and forming an annular volume within the wellbore between the casing and the antenna; a generating unit for generating electromagnetic energy of at least one RF frequency; and a transmission line in electrical communication with the generating unit and in electrical communication with the RF antenna for transmitting electromagnetic energy from the generating unit to the RF antenna; wherein the RF antenna has at least an antenna section comprising: an outer conductor having a longitudinal axis and having a circular cross-section having an inside diameter perpendicular to the longitudinal axis, and further having at least one aperture; an inner conductor that is coaxial to the outer conductor and having a circular cross-section having an outside diameter; and an annular space defined by the inside diameter of the outer conductor and the outside diameter of the inner conductor, the annular space containing a dielectric material having a $2^{nd}$ relative electrical permittivity that is less than the $1^{st}$ relative electrical permittivity; and wherein a ratio b/a of the inside diameter of the outer conductor (b) and the outside diameter of the inner conductor (a) remains uniform along the longitudinal axis for a constant characteristic impedance, and wherein the b/a ratio ranges from 1.5 to 10; wherein the at least one aperture is arranged for the antenna to have a circumferential radiation of at least 180 degrees along the longitudinal axis; wherein the antenna has an operational RF power signal frequency from 5 kHz to 20 MHz; wherein the antenna has a radiation power from 0.5 kW/m to 50 kW/m per longitudinal length of the antenna.

2. A method for using RF to heat a subterranean formation, the method comprising: providing a wellbore extending at least into an oil-bearing region in a subterranean formation; providing an radio frequency (RF) antenna in the wellbore to extend at least into the oil-bearing region; providing a RF signal generator for supplying harmonic time-varying sinusoidal waveforms to the antenna via a transmission system; providing a transmission line in electrical communication with the RF signal generator and in electrical communication with the RF antenna for transmitting electromagnetic energy from the RF signal generator to the RF antenna to provide thermal energy to the subterranean formation; wherein the RF antenna has at least an antenna section comprising: an outer conductor having a longitudinal axis and having a circular cross-section having an inside diameter perpendicular to the longitudinal axis, and further having at least one aperture; an inner conductor that is coaxial to the outer conductor and having a circular cross-section having an outside diameter; and an annular space defined by the inside diameter of the outer conductor and the outside diameter of the inner conductor, the annular space containing a dielectric material having a $2^{nd}$ relative electrical permittivity that is less than the $1^{st}$ relative electrical permittivity; and wherein a ratio b/a of the inside diameter of the outer conductor (b) and the outside diameter of the inner conductor (a) remains uniform along the longitudinal axis for a constant characteristic impedance, and wherein the b/a ratio ranges from 1.5 to 10; wherein the at least one aperture is arranged for the antenna to have a circumferential radiation of at least 180 degrees along the longitudinal axis; wherein the antenna has an operational RF power signal frequency from 5 kHz to 20 MHz; wherein the antenna has a radiation power from 0.5 kW/m to 50 kW/m per longitudinal length of the antenna.

3. A method for radio frequency (RF) in-situ heating of a subterranean formation for recovering hydrocarbons contained therein, the formation has a $1^{st}$ relative electrical permittivity ranging from 2.5 to 1000 and an electrical conductivity ranging from 5.0 S/m to $4\times10^{-4}$ S/m, the method comprising: providing an RF signal generator for supplying harmonic time-varying sinusoidal waveforms (RF electromagnetic power) to the antenna via a transmission system; providing a transmission system; providing RF electromagnetic power to the coaxial antenna for heating at least a portion of the subsurface formation; providing a coaxial antenna in the subsurface formation; wherein the antenna has at least an antenna section comprising: an outer conductor having a longitudinal axis and having a circular cross-section having an inside diameter perpendicular to the longitudinal axis, and further having at least one aperture; an inner conductor that is coaxial to the outer conductor and having a circular cross-section having an outside diameter; and an annular space defined by the inside diameter of the outer conductor and the outside diameter of the inner conductor, the annular space containing a dielectric material having a $2^{nd}$ relative electrical permittivity that is less than the $1^{st}$ relative electrical permittivity; and wherein a ratio b/a of the inside diameter of the outer conductor (b) and the outside diameter of the inner conductor (a) remains uniform along the longitudinal axis for a constant characteristic impedance, and wherein the b/a ratio ranges from 1.5 to 10; wherein the at least one aperture is arranged for the antenna to have a circumferential radiation of at least 180 degrees along the longitudinal axis; wherein the antenna has an operational RF power signal frequency from 5 kHz to 20 MHz; wherein the antenna has a radiation power from 0.5 kW/m to 50 kW/m per longitudinal length of the antenna.

4. The method of claim 3, wherein the electromagnetic power is provided from a radio frequency signal generator electrically coupled to the antenna.

5. The method of claim 3, wherein the antenna has a length in a range from 30 meters to 3000 meters.

6. The method of claim 3, further comprising heating at least a portion of the subsurface formation to a minimum temperature of greater than 60° C.

7. The method of claim 3, further comprising heating at least a portion of the subsurface formation by at least 20° C.

8. The method of claim 3, further comprising providing electromagnetic power at a radio frequency in a range from 5 kHz to 20 MHz.

9. The method of claim 3, further comprising providing single mode RF electromagnetic power, operating at a single operating radio frequency within the range from 5 kHz to 20 MHz.

10. The method of claim 3, further comprising providing multi-mode RF electromagnetic power, with at least two harmonic time-varying sinusoidal waveforms, and having different frequencies within the range from 5 kHz to 20 MHz.

11. The method of claim 3, further comprising providing electromagnetic power at a in a range from 3 kW to 2.0 MW.

12. The method of claim 3, further comprising providing electromagnetic power per longitudinal unit length in a range from 0.1 kW/m to 50 MW.

13. The method of claim 3, further comprising providing the coaxial antenna in a vertical wellbore extending into the subsurface formation.

14. The method of claim 3, further comprising providing the coaxial antenna in a horizontal section of a wellbore in the subsurface formation.

15. The method of claim 3, further comprising supplying steam to the formation in combination with radio frequency heating to improve the recovery of hydrocarbons.

16. The method of claim 3, further comprising: collecting production brine in the wellbore; and supplying sufficient electromagnetic power through the coaxial antenna to vaporize at least a portion of the production brine and generate steam for steam heating at least a portion of the formation.

17. A method for using radio frequency in-situ heating of a subsurface formation for recovering hydrocarbons contained therein, the formation having a $1^{st}$ relative electrical permittivity (DC), the method comprising: providing a coaxial antenna in the subsurface formation; providing electromagnetic power to the coaxial antenna for heating at least a portion of the subsurface formation, the antenna comprising: an outer conductor having a longitudinal axis and a cross section diameter perpendicular to the longitudinal axis, and further having at least one aperture; a hollow inner conductor that is coaxial to the outer conductor for supplying fluids to the wellbore and for producing fluids from the wellbore, and providing heat to the formation and producing fluids therefrom, and passing the produced fluids through the inner conductor for surface processing.

18. A method for using radio frequency in-situ heating of a subsurface formation for recovering hydrocarbons contained therein, the formation having a $1^{st}$ relative electrical permittivity (DC), the method comprising: providing a coaxial antenna in the subsurface formation; providing electromagnetic power to the coaxial antenna for heating at least a portion of the subsurface formation, the antenna comprising: an outer conductor having a longitudinal axis and a cross section diameter perpendicular to the longitudinal axis, and further having at least one aperture; a hollow inner conductor that is coaxial to the outer conductor for supplying fluids to the wellbore and for producing fluids from the wellbore, and providing an aqueous fluid to the wellbore through the inner conductor; providing heat to the formation and further providing heat to vaporize at least a portion of the aqueous fluid in the wellbore for generating steam in the wellbore; and producing fluids therefrom.

19. The method of claim 18, further comprising passing the produced fluids through the inner conductor for surface processing.

20. A method for using radio frequency in-situ heating of a subsurface formation for recovering hydrocarbons contained therein, the formation having a $1^{st}$ relative electrical permittivity (DC), the method comprising: providing a coaxial antenna in the subsurface formation; providing electromagnetic power to the coaxial antenna for heating at least a portion of the subsurface formation, the antenna comprising: an outer conductor having a longitudinal axis and a cross section diameter perpendicular to the longitudinal axis, and further having at least one aperture; an inner conductor that is coaxial to the outer conductor; and an annular space formed by the outer conductor and the inner conductor, the annular space containing a dielectric fluid, and adjusting the relative electrical permittivity of the dielectric fluid while heating the formation such that the relative electrical permittivity of the dielectric fluid is less than the relative electrical permittivity of the formation.

21. A method for using radio frequency in-situ heating of a subsurface formation for recovering hydrocarbons contained therein, the formation having a $1^{st}$ relative electrical permittivity (DC), the method comprising: providing a coaxial antenna in the subsurface formation; providing electromagnetic power to the coaxial antenna for heating at least a portion of the subsurface formation, the antenna comprising: an outer conductor having a longitudinal axis and a cross section diameter perpendicular to the longitudinal axis, and further having at least one aperture; an inner conductor that is coaxial to the outer conductor; and an annular space formed by the outer conductor and the inner conductor, the annular space containing a liquid dielectric fluid, heating the formation for a time to remove at least a portion of the connate water present in the formation; and replacing at least a portion of the liquid dielectric fluid in the annular space with a gaseous dielectric fluid.

What is claimed is:

1. A coaxial antenna for radio frequency (RF) in-situ heating of a subterranean formation, the formation having a $1^{st}$ relative electrical permittivity and an electrical conductivity, the antenna having at least an antenna section comprising:

an outer conductor having a longitudinal axis and having a circular cross-section having an inside diameter perpendicular to the longitudinal axis, and further having at least one aperture;

an inner conductor that is coaxial to the outer conductor and having a circular cross-section having an outside diameter; and an annular space defined by the inside diameter of the outer conductor and the outside diameter of the inner conductor, the annular space containing a dielectric material having a $2^{nd}$ relative electrical permittivity that is less than the $1^{st}$ relative electrical permittivity;

wherein a ratio b/a of the inside diameter of the outer conductor (b) and the outside diameter of the inner conductor (a) remains uniform along the longitudinal axis for a constant characteristic impedance, and wherein the b/a ratio ranges from 1.5 to 10;

wherein the at least one aperture is arranged for the antenna to have a circumferential radiation of at least 180 degrees along the longitudinal axis;

wherein the antenna has an operational RF power signal frequency from 5 kHz to 20 MHz;

wherein the antenna has a radiation power from 0.5 kW/m to 50 kW/m per longitudinal length of the antenna, wherein the $1^{st}$ relative electrical permittivity ranges from 2.5 to 1000 and the electrical conductivity of the formation ranges from 5.0 Siemens/meter to $4\times10^{-4}$ Siemens/meter.

2. The antenna of claim 1, wherein the at least one aperture is arranged for the antenna to have a full 360 degree circumferential radiation along the longitudinal axis.

3. The antenna of claim 1, wherein the at least one aperture is arranged for the antenna to have circumferential radiation of at most 180 degrees along the longitudinal axis.

4. The antenna of claim 1, wherein the antenna comprises at least two antenna sections each with an outer conductor and an inner conductor, and wherein the circular cross-sections of the outer conductors are different, for a step-wise change in characteristic impedance.

5. The antenna of claim 1, wherein the antenna comprises at least two antenna sections each with an outer conductor and an inner conductor, and wherein the b/a ratio remains the same along the longitudinal axis of the antenna.

6. The antenna of claim 1, wherein the at least one aperture is configured to have a size and shape selected from rectangular, elliptical, helical, angled, and arbitrary shaped apertures for the antenna to have a predetermined radiation pattern and radiation power within the subterranean formation.

7. The antenna of claim 1, wherein the at least one aperture is of a radial aperture, a helical aperture, a longitudinal aperture, and combinations thereof.

8. The coaxial antenna of claim 1, wherein the dielectric material has a relative electrical permittivity in a range from 1 to 25.

9. The coaxial antenna of claim 1, wherein the dielectric material is any of a gaseous dielectric material, a liquid dielectric material, a solid dielectric material, and combinations thereof.

10. The coaxial antenna of claim 1, wherein the outer conductor comprises at least one helical aperture having a pitch angle $\alpha$ in a range from 5° to 85°.

11. The coaxial antenna of claim 1, wherein the at least one aperture has an angular length ranging from 0.5 radians to 36 radians.

12. The coaxial antenna of claim 1, wherein the coaxial antenna has a proximal end adjacent to an electrical input to the antenna and a distil end farthest from the electrical input, and wherein the coaxial antenna comprises at least a first helical aperture adjacent the proximal end, the first helical aperture having a 1st length in a range from 0.5 to 5 helical windings per aperture; and at least a second helical aperture adjacent the distil end, the second helical aperture having a 2nd length in a range from 1 to 10 helical windings per aperture, the first length being at least ¼ winding greater than the 2nd length.

13. The coaxial antenna of claim 1, wherein the outer conductor comprises at least two apertures, a $1^{st}$ aperture having a 1st pitch angle $\alpha_1$ and a $2^{nd}$ aperture having a 2nd pitch angle $\alpha_2$, wherein the $1^{st}$ pitch angle $\alpha_1$ and the $2^{nd}$ pitch angle $\alpha_2$ differs by at least 5° from each other.

14. The coaxial antenna of claim 1, wherein the antenna has a length in a range from 30 meters to 3000 meters.

15. The coaxial antenna of claim 1, wherein the at least one helical aperture is sealed with a dielectric material that is transparent to electromagnetic radiation radio frequency range of 5 kHz to about 20 MHz.

16. The coaxial antenna of claim 15, wherein the dielectric material for sealing the at least one helical aperture has a relative electrical permittivity in a range from 1 to 10.

17. The coaxial antenna of claim 1, wherein the outer conductor and inner conductor each comprises a conductive material selected from the group consisting of aluminum, aluminum alloys, copper, copper alloys, steel and steel alloys, and combinations thereof, including cladding of steel and steel alloys.

18. The coaxial antenna of claim 1, wherein the outer conductor and inner conduct each comprises a dielectric material and a conductive layer, and wherein the conductive layer comprises a material selected from aluminum, aluminum alloys, copper, steel, non-magnetic steel, gold, silver, metal alloys, carbon-fibers, graphene and combinations thereof.

19. A system for using the coaxial antenna of claim 1 for radio frequency (RF) in-situ for heating at least a portion of a subsurface formation having a $1^{st}$ relative electrical permittivity to a minimum temperature of greater than 60° C.

20. The system of claim 19, wherein the system comprises: the RF antenna of claim 1, positioned in a wellbore extending into a subterranean formation and having an RF transparent casing in a hydrocarbon-containing region of the subterranean formation; a generating unit electrically coupled to the RF antenna for generating electromagnetic energy of at least one RF frequency; a transmission line in electrical communication with the generating unit and in electrical communication with the RF antenna for transmitting electromagnetic energy from the generating unit to the RF antenna; and a RF signal generator for supplying harmonic time-varying sinusoidal waveforms to the RF antenna via a transmission system.

* * * * *